United States Patent [19]

Komukai

[11] Patent Number: 4,662,539

[45] Date of Patent: May 5, 1987

[54] FUEL SUPPLYING APPARATUS

[75] Inventor: Shigemi Komukai, Yokohama, Japan

[73] Assignee: Tokico Ltd., Kawasaki, Japan

[21] Appl. No.: 631,642

[22] Filed: Jul. 17, 1984

[30] Foreign Application Priority Data

Jul. 20, 1983 [JP] Japan ..... 58-132282

[51] Int. Cl.[4] ..... B67D 5/30; B67D 5/12; B67D 1/16

[52] U.S. Cl. ..... 222/14; 222/39; 222/40; 222/63; 222/75; 222/109; 340/568

[58] Field of Search ..... 222/14, 15, 16, 17, 222/20, 21, 23, 39, 40, 63, 108, 109, 74, 75; 340/605, 609, 540, 568

[56] References Cited

U.S. PATENT DOCUMENTS

| | | | |
|---|---|---|---|
| 4,090,179 | 5/1978 | Hirano | 340/605 |
| 4,354,620 | 10/1982 | Tsuneda et al. | 222/14 |
| 4,397,405 | 8/1983 | Batson | 222/14 |
| 4,442,953 | 4/1984 | Miyamoto et al. | 222/14 |

FOREIGN PATENT DOCUMENTS 56-48997 5/1981 Japan .

*Primary Examiner*—Joseph J. Rolla
*Assistant Examiner*—Andrew Jones
*Attorney, Agent, or Firm*—Roberts, Spiecens & Cohen

[57] ABSTRACT

A fuel supplying apparatus comprises a switch for driving a pump in response to unhooking of a fuel supplying nozzle from an accommodating part, a circuit for driving the pump and carrying out a fuel supplying operation until a preset fuel supplying quantity or a preset amount of money is reached, where the preset fuel supplying quantity and the preset amount of money are preset before the preset fuel supplying operation is started, a circuit for driving the pump for a predetermined short time in response to accommodation of the fuel supplying nozzle in the accommodating part after completion of the preset fuel supplying operation, and a circuit for comparing a measured flow rate which is measured in the flowmeter and a predetermined flow rate when the pump is driven for the predetermined short time, and for prohibiting the pump from being driven in response to the unhooking of the fuel supplying nozzle from the accommodating part when the measured flow rate is greater than the predetermined flow rate, even when the switch operates.

8 Claims, 9 Drawing Figures

CONT CKT
20
ALARM
21
MOTOR DRIV
22
M
5
E
INDIC
13
INDIC DRIV
23
FLIP FLOP
47
47Q
47Q̄
47S
47R
S
R
Q
Q̄
MEM
43
COMP
45
45A
COUNT R
41
41R
MONO MULTI
35
MONO MULTI
37
MONO MULTI
38
MONO MULTI
36
MEM
44
COMP
46
46A
R COUNT
42
42R
24
25
26
27
28
29
30
31
32
33
34
39
40
FLOW RATE SIG GENE
8
SW
12
PRESET DEVICE
17

CONT CKT
20a
FLOW RATE SIG GENE
8
SW
12
COUNT R
41
41R
COMP
45
45A
MEM
43
MONO MULTI
35
24
ALARM
21
FLIP FLOP
47
47Q
47R
47S
MONO MULTI
82
28
33
PULSE GENE R
83
83R
25
31
29
30
34
40
80
81
MOTOR DRIV
22
M
5
MEM
85
COMP
86
86A
R COUNT
84
84R
MONO MULTI
36
27
39
42R
R COUNT
42
COMP
46
46A
MEM
44
INDIC DRIV
23
INDIC
13
26
PRESET DEVICE
17

FUEL SUPPLYING APPARATUS

BACKGROUND OF THE INVENTION

The present invention generally relates to fuel supplying apparatuses, and more particularly to a fuel supplying apparatus which is designed to prevent a fuel supplying operation from being started in a state where a valve of a fuel supplying nozzle is open when the fuel supplying nozzle is accommodated in a nozzle accommodating part after the completion of a previous fuel supplying operation without the operator being aware that the valve of the fuel supplying nozzle remains open.

Conventionally, there was a known preset type fuel supplying apparatus. According to this preset type fuel supplying apparatus, a desired quantity of fuel or a desired amount of money is preset, so that a predetermined quantity of fuel which corresponds to the preset value is supplied.

The above type of a fuel supplying apparatus comprises a pump and a flowmeter which are generally provided within a housing, a piping arrangement having one end thereof coupled to the pump and the flowmeter and having the other end thereof coupled to a fuel supplying hose, a fuel supplying nozzle provided at the tip end of the hose, a nozzle accommodating part which is provided on the housing so as to accommodate the fuel supplying nozzle, a switch mechanism which drives the pump when the fuel supplying nozzle is unhooked from the nozzle accommodating part, and a preset mechanism which carries out the fuel supplying operation so that a predetermined quantity of fuel which corresponds to a desired quantity of fuel or a desired amount of money which has been preset is supplied. In this fuel supplying apparatus, the desired quantity of fuel or the desired amount of money is preset in the preset mechanism, and the fuel supplying nozzle is unhooked from the nozzle accommodating part to supply the fuel to a fuel tank of a vehicle and the like. When the quantity of the fuel which is supplied to the fuel tank reaches the preset quantity, the pump is stopped from being driven so as to terminate the fuel supplying operation. The fuel supplying nozzle is then hooked back to be accommodated in the nozzle accommodating part, and in this state, the fuel supplying apparatus is ready to carry out a subsequent fuel supplying operation.

However, the fuel supplying operation which is carried out in the preset type fuel supplying apparatus described above, is different from the fuel supplying operation which is carried out in the regular type fuel supplying apparatus which depends on the operator's manual operation to open and close the valve of the fuel supplying nozzle. That is, in the preset type fuel supplying apparatus, the predetermined quantity of fuel is supplied by automatically stopping the pump from being driven when the quantity of the supplied fuel reaches the preset quantity. Thus, the operator may hook the fuel supplying nozzle in the nozzle accommodating part, without being aware that the valve of the fuel supplying nozzle still remains open. As a result, when the open fuel supplying nozzle is unhooked from the accommodating part so as to start a subsequent fuel supplying operation, the switch mechanism will operate immediately and drive the pump. Therefore, there is a danger in that the fuel mauy be supplied through the fuel supplying nozzle before the fuel supplying nozzle is inserted into a fuel supplying opening in the fuel tank of the vehicle.

Accordingly, there was an apparatus which was designed so that the pump will not be driven unless it is checked before the fuel supplying operation is started whether the valve of the fuel supplying nozzle is open. However, in this apparatus, the state of the valve of the fuel supplying nozzle had to be checked every time a fuel supplying operation is carried out, and there was a disadvantage in that such checking of the state of the valve of the fuel supplying nozzle was troublesome to perform.

SUMMARY OF THE INVENTION

Accordingly, it is a general object of the present invention to provide a novel and useful fuel supplying apparatus in which the above described disadvantages have been overcome.

Another and more specific object of the present invention is to provide a fuel supplying apparatus which automatically checks whether a valve of a fuel supplying nozzle is open after a preset fuel supplying operation is completed, and prohibits a subsequent fuel supplying operation from being carried out only when the valve of the fuel supplying nozzle is open after the preset fuel supplying operation is completed. The fuel supplying apparatus according to the present invention comprises pump driving means for driving a pump only for a short period of time in response to the operation of a switch mechanism which is provided in a nozzle accommodating part when the fuel supplying nozzle is accommodated in the nozzle accommodating part after the preset fuel supplying operation is completed, and a safety check means for comparing a predetermined flow rate with a flow rate which is measured in a flowmeter when the pump is driven and for prohibiting the pump from being driven if the measured flow rate is greater than the predetermined flow rate, even when the fuel supplying nozzle is unhooked from the nozzle accommodating part and the switch mechanism operates. When the preset fuel supplying operation is completed and the fuel supplying nozzle is accommodated in the nozzle accommodating part, the pump driving means drives the pump for only the short period of time. The flow rate during this short period of time in which the pump is driven by the pump driving means, is discriminated in the safety check means, and the safety check means prohibits the pump from being driven during the subsequent fuel supplying operation. As a result, even when a preset type fuel supplying apparatus is employed, it is possible to prevent the fuel from being accidentally supplied through the fuel supplying nozzle at the instant when the fuel supplying nozzle is unhooked from the nozzle accommodating part so as to start the subsequent fuel supplying operation.

Still another object of the present invention is to provide a fuel supplying apparatus in which the pump driving means for driving the pump for the short period of time, intermittently drives the pump in terms of a minute time repeatedly for a plurality of times, and in which the safety check means prohibits the pump from being driven when a sum of the flow rates measured by the flow meter as the pump is intermittently driven reaches the predetermined flow quantity. According to the fuel supplying apparatus of the present invention, the quantity of fuel which leaks from the fuel supplying nozzle is small, even when the valve of the fuel supplying nozzle remains open.

Other objects and further features of the present invention will be apparent from the following detailed description when read in conjunction with the accompanying drawings.

DETAILED DESCRIPTION

Figure 1:
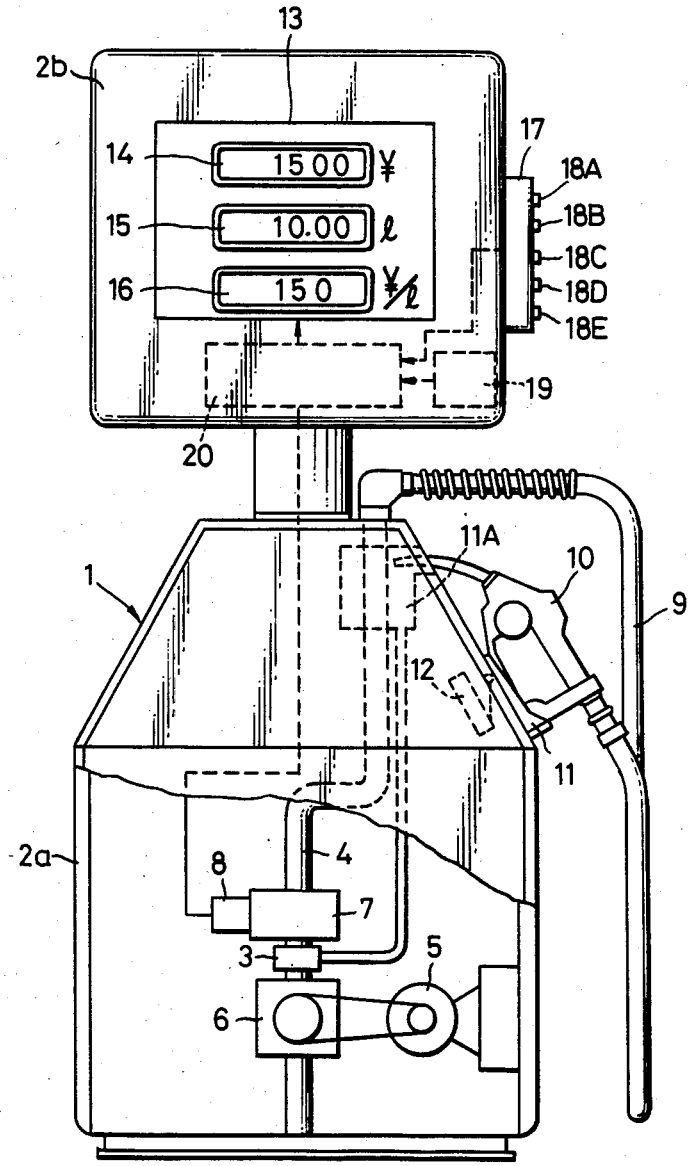
FIG. 1 shows a general construction of an embodiment of a fuel supplying apparatus according to the present invention.

In FIG. 1, a housing 1 of a fixed type fuel supplying apparatus, comprises a lower housing *2a* and an upper housing *2b*. A piping arrangement 4 is provided within the lower housing *2a*. One end of this piping arrangement 4 is coupled to a tank (not shown). A pump 6 which is driven by a motor 5, and a flowmeter 7 for measuring the quantity of supplied fuel, are respectively provided in an intermediate part of the piping arrangement 4. The flowmeter 7 is provided with a flow rate signal generator 8. The flow rate signal generator 8 generates a flow rate signal which is proportional to the flow rate which is measured in the flowmeter 7. In addition, a fuel supplying hose 9 is coupled to the other end of the piping arrangement 4. This fuel supplying hose 9 comprises a fuel supplying nozzle 10 at a tip end thereof.

A nozzle accommodating part 11 is located in the lower housing *2a*, for accommodating the fuel supplying nozzle 10 when the fuel supplying operation is not carried out. The nozzle accommodating part 11 comprises a switch 12. This switch 12 is closed when the fuel supplying nozzle 10 is unhooked from the nozzle accommodating part 11, and is open when the fuel supplying nozzle is accommodated in the nozzle accommodating part 11. As will be described later on in the specification, the motor 5 is driven to rotate when the switch 12 closed, and the motor 5 stops rotating when the switch 12 opens. A fuel collecting device 11A is provided in the nozzle accommodating part 11, and the tip end of the fuel supplying nozzle 10 is inserted into this fuel collecting device 11A in a state where the fuel supplying nozzle 10 is accommodated in the nozzle accommodating part 11. For example, the fuel collecting device 11A collects the fuel which leaks from the fuel supplying nozzle 10, and returns the collected fuel to the piping arrangement 4 through an air separator 3.

On the other hand, an indicator device 13 is located at the front of the upper housing *2b*. The indicator device 13 comprises an indicator 14 for displaying the amount of money, an indicator 15 for displaying the quantity of fuel, and an indicator 16 for displaying the unit price. A preset device 17 is located at the rear of the upper housing *2b*. For example, the preset device 17 comprises presetting buttons 18A, 18B, 18C, 18D, and 18E for presetting the quantity of fuel which is to be supplied to 10 liters, 15 liters, 20 liters, 30, liters, and 40 liters. Thus, a desired quantity of fuel which is to be supplied, can be preset by pushing an arbitrary presetting button from among the presetting buttons 18A, 18B, 18C, 18D, and 18E.

The presetting buttons 18A, 18B, 18C, 18D, and 18E are not limited to presetting the quantity of fuel which is to be supplied. For example, the presetting buttons 18A, 18B, 18C, 18D, and 18E may be designed to preset the amount of money to 1,000 Yens, 1,500 Yens, 2,000 Yens, 3,000 Yens, and 4,000 Yens. Further, the presetting buttons for presetting the quantity of fuel and the presetting buttons for presetting the amount of money, may be provided simultaneously. Moreoever, a dial type setting device may be provided instead of the presetting buttons 18A, 18B, 18C, 18D, and 18E, so that the setting can be varied continuously.

Figure 2:
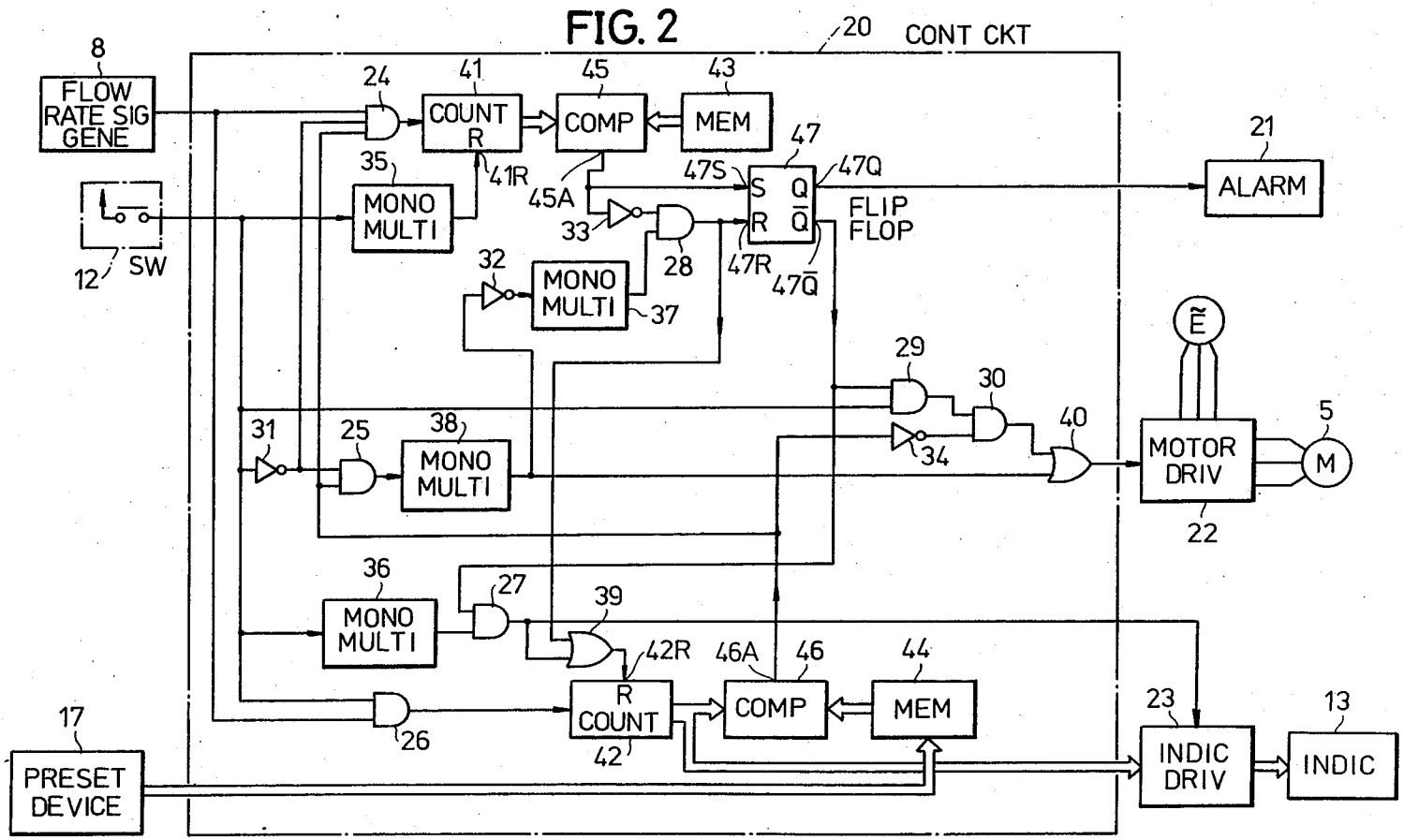
FIG. 2 is a circuit diagram showing a first embodiment of a concrete circuit construction of a control circuit in the apparatus shown in FIG. 1.

A unit price setting device 19 and a control circuit 20 which is shown in FIG. 2 and will be described later on in the specification, are built into the upper housing *2b*. The unit price which is set in the unit price setting device 19, is displayed on the indicator 16 through the control circuit 20. The unit price setting device 19 is only operated when there is a change in the unit price of the fuel. Thus, the unit price setting device 19 is normally covered by the upper housing *2b*.

A first embodiment of a concrete circuit construction of the control circuit 20 is shown in FIG. 2. The input of the control circuit 20 is coupled to the flow rate signal generator 8, the switch 12, and the preset device 17. On the other hand, the output of the control circuit 20 is coupled to an alarm 21 such as a buzzer and a lamp, a motor driving circuit 22, and an indicator driving circuit 23. The motor driving circuit 22 is coupled between an A.C. power source E and the motor 5, and controls the start and stoppage of the motor 5. In addition, the indicator driving circuit 23 is coupled to the indicator device 13, and controls the display operation of the indicator device 13. The indicator driving circuit 23 converts signals obtained from counting circuits which will be described hereinafter, into indicator driving signals for each digit.

The control circuit 20 comprises AND circuits 24, 25, 26, 27, 28, 29, 30, inverters 31, 32, 33, and 34, monostable multivibrators 35, 36, and 37 which are employed as trigger circuits, a monostable multivibrator 38 which is employed as a timer, OR circuits 39 and 40, counting circuits 41 and 42 for counting the flow rate signal from the flow rate signal generator 8, memory circuits 43 and 44, comparing circuits 45 and 46, and a flip-flop 47. As will be described later on in the specification, the monostable multivibrator 38 is employed as a timer to drive the motor 5 for a predetermined short time t which is a minimum time which would permit at least a predetermined flow rate to be supplied through the fuel supplying nozzle 10, if the valve of the fuel supplying nozzle 10 remains open when a safety check is made after the fuel supplying nozzle 10 is accommodated in the nozzle accommodating part 11. The memory circuit 43 stores a predetermined flow rate (0.05 liters, for example) which may be absorbed by the expansion of the fuel supplying hose 9 when the safety check is made. The memory circuit 44 stores the preset quantity which is preset in the preset device 17. The comparing circuit 45 compares the fuel supplying quantity which is counted in the counting circuit 41 and the predetermined flow rate which is stored in the memory circuit 43, and produces a coincidence signal when the two quantities coincide. On the other hand, the comparing circuit 46 compares the fuel supplying quantity which is counted in the counting circuit 42 and the preset quantity which is stored in the memory circuit 44, and produces a fixed quantity signal when the two quantities coincide.

The output of the flow rate signal generator 8 is coupled to the inputs of the AND circuits 24 and 26. The output of the the AND circuit 24 is coupled to the input of the counting circuit 41, and the output of the AND circuit 26 is coupled to the input of the counting circuit 42. The output of the switch 12 is coupled to a reset terminal 41R of the counting circuit 41 through the monostable multivibrator 35, and to the inputs of the AND circuits 26 and 29. Further, the output of the switch 12 is coupled to the inputs of the AND circuits 24 and 25 through the inverter 31, and to the input of the AND circuit 27 through the monostable multivibrator 36. The output of the preset device 17 is coupled to the input of the memory circuit 44.

The input of the comparing circuit 46 is coupled to the output of the counting circuit 42 and to the output of the memory circuit 44. An output terminal 46A of the comparing circuit 46, through which the fixed quantity signal is produced, is coupled to the inputs of the AND circuits 24 and 25, and to the input of the AND circuit 30 through the inverter 34. In addition, the output of the counting circuit 42 is coupled to the input of the indicator device 13, through the indicator driving circuit 23. The output of the AND circuit 25 is coupled to the input of the monostable multivibrator 38. The output of the monostable multivibrator 38 is coupled to the input of the AND circuit 28 through the inverter 32 and the monostable multivibrator 37, and to the input of the motor driving circuit 22 through the OR circuit 40. On the other hand, the output of the AND circuit 27 is coupled to a reset terminal 42A of the counting circuit 42 through the OR circuit 39, and to the input of the indicator driving circuit 23.

The input of the comparing circuit 45 is coupled to the output of the counting circuit 41 and to the output of the memory circuit 43. An output terminal 45A of the comparing circuit 45, through which the coincidence signal is produced, is coupled to the input of the AND circuit 38 through the inverter 33, and to a set terminal 47S of the flip-flop 47. The output of the AND circuit 28 is coupled to a reset terminal 47R of the flip-flop 47, and to the input of the OR circuit 39. Moreover, a set output terminal 47Q of the flip-flop 47 is coupled to the input of the alarm 21. A reset output terminal 47$\overline{Q}$ of the flip-flop 47 is coupled to the inputs of the AND circuits 27 and 29. The output of the AND circuit 29 is coupled to the input of the AND circuit 30, and the output of the AND circuit 30 is coupled to the input of the OR circuit 40.

Next, description will be given with respect to the operation of a first embodiment of a fuel supplying apparatus according to the present invention, which has the construction described heretofore, by referring to the time chart of FIG. 3. FIGS. 3(a) through 3(W) respectively show the signal waveforms at the flow rate signal generator 8, the switch 12, the AND circuits 24, 25, 26, 27, 28, 29, and 30, the inverters 31, 32, 33, and 34, the monostable multivibrators 35, 36, 37, and 38, or OR circuits 39 and 40, the output terminal 45A of the comparing circuit 45, the output terminal 46A of the comparing circuit 46, and the output terminals 47A and 47$\overline{Q}$ of the flip-flop 47. in FIGS. 3(A) through 3(W), a time $t_1$ indicates a time when the fuel supplying nozzle 10 is unhooked from the nozzle accommodating part 11, a time $t_2$ indicates a time when the valve of the fuel supplying nozzle 10 is opened, a time $t_3$ indicates a time when the valve of the fuel supplying nozzle 10 is closed, and a time $t_4$ indicates a time when the fuel supplying nozzle 10 is hooked back in the nozzle accommodating part 11. A period $T_1$ indicates the duration of a normal fuel supplying operation. A time $t_5$ indicates a time when the fuel supplying nozzle 10 is unhooked from the nozzle accommodating part 11, a time $t_6$ indicates a time when the valve of the fuel supplying nozzle 10 is opened, and a time $t_7$ indicates a time when the fixed quantity signal is generated. A period $T_2$ indicates the duration of a preset fuel supplying operation. Among times $t_8$ through $t_{13}$, the time $t_8$ indicates a time when the fuel supplying nozzle 10 is hooked back in the nozzle accommodating part 11, the time $t_{10}$ indicates a time when the fuel supplying nozzle 10 is unhooked from the nozzle accommodating part 11, the time $t_{11}$ indicates a time when the valve of the fuel supplying nozzle 10 is closed, and the time $t_{12}$ indicates a time when the fuel supplying nozzle 10 is hooked back in the nozzle accommodating part 11. A period $T_3$ indicates the duration of a checking operation in which the open state of the fuel supplying nozzle 10 is checked.

Before the fuel supplying apparatus is operated, the fuel supplying nozzle 10 is accommodated in the nozzle accommodating part 11, and the switch 12 is open. In addition, the control circuit 20 is in a normal state, and the reset output terminal 47$\overline{Q}$ of the flip-flop 47 is in the set state. Furthermore, the counting circuits 41 and 42 are respectively reset of the previous fuel supplying quantity. In this state, only the outputs of the inverters 31, 32, and 34 are high, and the outputs of the other related circuits remain low.

First, description will be given with respect to the normal fuel supplying operation which does not employ the preset device 17.

Figure 3:
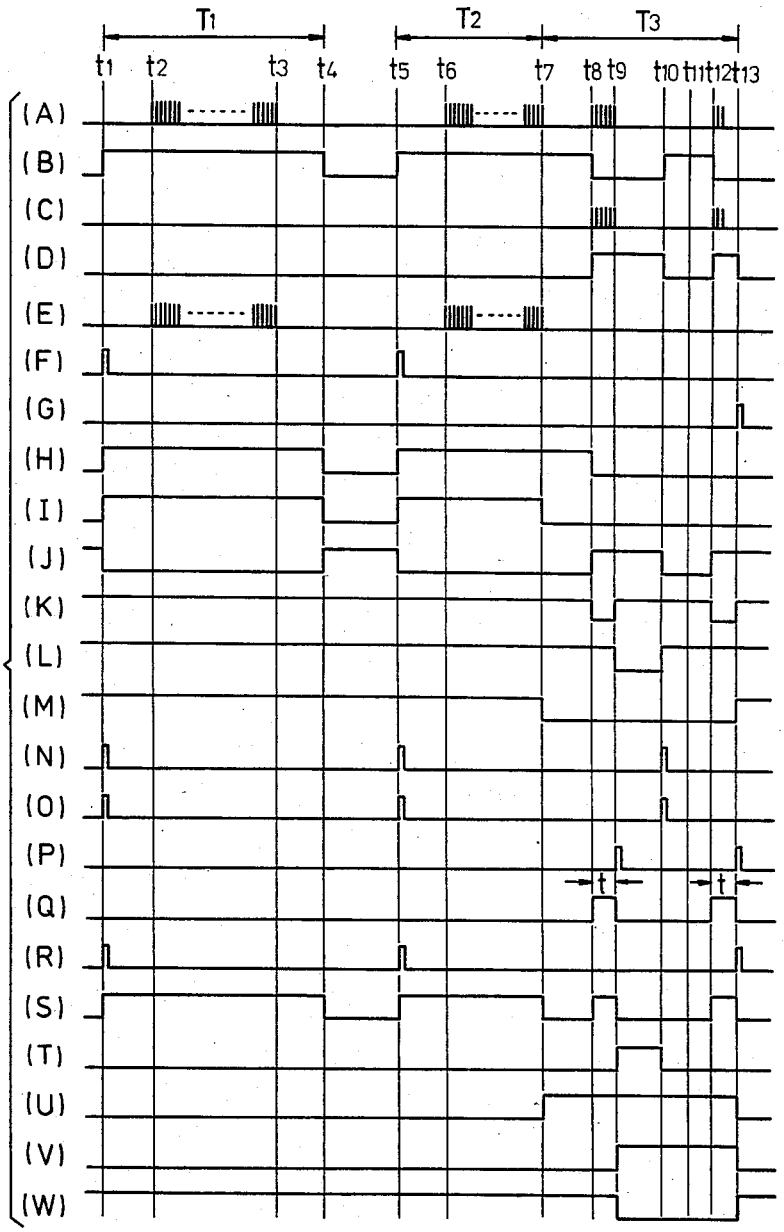
FIG. 3 is a time chart for explaining the operation of the circuit shown in FIG. 2.

When the fuel supplying nozzle 10 is unhooked from the nozzle accommodating part 11, the switch 12 closes as shown in FIG. 3(B). Thus, the output of the monostable multivibrator 35 assumes a high level for an instant as shown in FIG. 3(N), and this output of the monostable multivibrator 35 is applied to the reset terminal 41R of the counting circuit 41 to reset the count in the counting circuit 41. In addition, the output of the monostable multivibrator 36 assumes a high level for an instant as shown in FIG. 3(0), and the output of the AND circuit 27 accordingly assumes a high level for an instant as shown in FIG. 3(F). This output of the AND circuit 27 is applied to the reset terminal 42R of the counting circuit 42, through the OR circuit 39 which produces the signal shown n FIG. 3(R), to reset the counting circuit 42. On the other hand, when the output of the AND circuit 27 assumes the high level, the indicator driving circuit 23 is put into an operative state by this high-level output of the AND circuit 27. In the operative state of the indicator driving circuit 23, the indicators 14 and 15 are reset to zero. Further, when the switch 12 closes, the output of the AND circuit 29 assumes a high level as shown in FIG. 3(H), and the output of the AND circuit 30 hence assumes a high level as shown in FIG. 3(I). As a result, the output of the OR circuit 40 shown in FIG. 3(S), is applied to the motor driving circuit 22. Therefore, the A.C. voltage E from the A.C. power source is supplied to the motor 5, to start the motor 5 and drive the pump 6. In this state, the fuel supplying apparatus can carry out the normal fuel supplying operation.

When the fuel supplying nozzle 10 is inserted into the fuel tank of the vehicle and opened in the above state, the fuel from the tank passes through the piping arrangement 4, the pump 6, the flowmeter 7 and the fuel supplying hose 9, and is supplied through the fuel supplying nozzle 10. The flow rate is measured in the flowmeter 7 while the fuel is being supplied through the fuel supplying nozzle 10. A flow rate signal shown in FIG. 3(A) which is generated from the flow rate signal generator 8, is supplied to the AND circuits 24 and 26. In this state, the gate of the AND circuit 24 is closed by the output of the inverter 31, however, the gate of the AND circuit 26 is open by the output of the switch 12. Thus, the flow rate signal is passed through the AND circuit 42 wherein the flow rate signal is subjected to a binary coded decimal count. The output of the counting circuit 42 is supplied to the indicator device 13 through the indicator driving circuit 23, and the flow rate is successively accumulated and displayed on the indicator device 13.

The valve of the fuel supplying nozzle 10 is closed when the desired fuel supplying is reached, and the fuel supplying nozzle 10 having the closed valve is hooked back in the nozzel accommodating part 11. As a result, the switch 12 opens, and the output of the AND circuit 29 assumes a low level. This low-level output of the AND circuit 29 is supplied to the motor driving circuit 22 through the OR circuit 40, and the motor 5 is stopped by the output of the motor driving circuit 22. Consequently, the pump 6 is stopped from being driven, and the normal fuel supplying operation is completed.

Next, description will be given with respect to the preset fuel supplying operation which employs the preset device 17.

Before the preset fuel supplying operation is started, the presetting buttons 18A through 18E of the preset device 17 are manipulated to preset the desired fuel supplying quantity. When the desired fuel supplying quantity is preset, this desired fuel supplying quantity is stored in the memory circuit 44 as the preset quantity. Next, the switch 12 closes when the fuel supplying nozzle 10 is unhooked from the nozzle accommodating part 11. Hence, the motor 5 starts to rotate similarly as in the case of the normal fuel supplying operation described before, and the fuel supplying apparatus can carry out the fuel supplying operation in this state. When the fuel supplying nozzle 10 is inserted into the fuel tank of the vehicle and opened in this state, the fuel is supplied through the fuel supplying nozzle 10. The flow rate signal from the flow rate signal generator 8 is supplied to the counting circuit 42 through the AND circuit 26, and is counted in the counting circuit 42.

On the other hand, the comparing circuit 46 compares the preset quantity which is stored in the memory circuit 44 and the fuel supplying quantity which is successively counted in the counting circuit 42. When the two quantities which are compared in the comparing circuit 46 coincide, a fixed quantity signal shown in FIG. 3(U) is produced through the output terminal 46A. As a result, the fixed quantity signal is supplied to the inverter 34, and the inverter 34 produces a signal shown in FIG. 3(M). Accordingly, the output of the AND circuit 30 remains low even when the input of the AND circuit 29 is high due to the output shown in FIG. 3(W) from the reset output terminal 47$\overline{Q}$ of the flip-flop 47 and the output of the switch 12, because the output of the inverter 34 which is supplied to the AND circuit 30 is low. Thus, the output of the OR circuit 40 is supplied to the motor 5 through the motor driving circuit 22, to stop the rotation of the motor 5. The pump 6 is hence stopped from being driven, and the preset fuel supplying operation is completed.

When the preset fuel supplying operation is completed as described heretofore, the operator hooks the fuel supplying nozzle 10 back in the nozzle accommodating part 11. The switch 12 is thus opened, and the gates of the AND circuits 26 and 29 close to prepare for a subsequent fuel supplying operation.

During the preset fuel supplying operation, the rotation of the motor 5 is stopped by the fixed quantity signal from the comparing circuit 46. That is, unlike in the normal fuel supplying operation in which the valve of the fuel supplying nozzle 10 is closed upon completion of the normal fuel supplying operation, the valve of the fuel supplying nozzle 10 remains open upon completion of the preset fuel supplying operation. Accordingly, the operator must close the valve of the fuel supplying nozzle 10, when hooking the fuel supplying nozzle 10 back in the nozzle accommodating part 11 upon completion of the preset fuel supplying operation. However, the operator may forget to close the valve of the fuel supplying nozzle 10 and hook the open fuel supplying nozzle 10 back in the nozzle accommodating part 11.

Therefore, according to the fuel supplying apparatus of the present invention, discrimination is made when the fuel supplying nozzle 10 is hooked back in the nozle accommodating part 11, to determine whether the valve of the fuel supplying nozzle 10 remains open. The fuel supplying apparatus according to the present invention is designed to make a safety check so that the subsequent fuel supplying operation is prohibited if it is discriminated that the fuel supplying nozzle 10 has been hooked back in the nozzle accommodating part 11 with its valve in the open state.

Description will now be given with respect to the operation of making the safety check.

When the preset fuel supplying operation is completed and the fuel supplying nozzle 10 is hooked back in the nozzle accommodating part 11 to open the switch 12, the output of the inverter 31 becomes high as shown in FIG. 3(J). As a result, the AND circuit 25 which is supplied with the high-level output of the inverter 31 and the signal from the output terminal 46A of the comparing circuit 46, produces a high-level output as shown in FIG. 3(D). Hence, the output of the monostable multivibrator 38 assumes a high level only during a predetermined short time t as shown in FIG. 3(Q). The output of the monostable multivibrator 38 is supplied to the motor driving circuit 22 through the OR circuit 40, so that the motor 5 is rotated for only the short time t. The pump 6 is consequently driven for only the short time t. Accordingly, the fuel is passed through the piping arrangement 4, the pump 6, the flowmeter 7, and the fuel supplying hose 9, and supplied through the fuel supplying nozzle 10. In this case, even if the fuel leaks from the fuel supplying nozzle 10, the leaked fuel will be collected by the fuel collecting device 11A and will not leak outside the fuel supplying apparatus.

On the other hand, when the output of the inverter 31 assumes a high level, and the AND circuit 24 will be supplied with this high-level output of the inverter 31. Becasue the fixed quantity signal from the output terminal 46A of the comparing circuit 46 is also supplied to the AND circuit 24, the gate of the AND circuit 24 will be opened by the high-level output of the inverter 31. Hence, by driving the pump 6 for the predetermined short time t as described above, the flow rate which is measured in the flowmeter 7 is produced from the flow rate signal generator 8 as a flow rate signal. This flow rate signal is supplied to the counting circuit 41, through the AND circuit 24 which produces the signal shown in FIG. 3(C). The output signal of the AND circuit 24 is subjected to a binary coded count in the counting circuit 41 as the quantity of supplied fuel.

A predetermined flow rate is stored in the memory circuit 43. The comparing circuit 45 compares the predetermined quantity which is stored in the memory circuit 45 and the quantity of supplied fuel which is counted in the counting circuit 41. If the valve of the fuel supplying nozzle 10 is open, a quantity of fuel which is greater than the predetermined flow quantity will flow through the fuel supplying nozzle 10 when the pump 6 is driven. Thus, a coincidence signal shown in FIG. 3(T) will be produced through the output terminal 45A of the comparing circuit 45. This coincidence signal is applied to the set terminal 47S of the flip-flop 47, so as to set the flip-flop 47. A set signsl shown in FIG. 3(V) is produced through the set output terminal 47Q of the flip-flop 47, and this set signal operates the alarm 21 such as a buzzer and a lamp. Accordingly, the operator will be alarmed that the valve of the fuel supplying nozzle 10 is open. When the operator is alarmed in this manner, the operator closes the valve of the fuel supplying nozzle 10 as will be described later on in the specification.

Even if the alarm 21 does not operate, or the operator does not sense the alarm, or the operator ignores the alarm and does not close the valve of the fuel supplying nozzle 10, the signal level at the reset output terminal 47$\overline{Q}$ of the flip-flop 47 remains low. Thus, when the fuel supplying nozzle 10 is unhooked from the nozzle accommodating part 11 and the switch closes upon starting of a subsequent fuel supplying operation, the output of the AND circuit 29 will remain low. Therefore, the motor 5 will not start to rotate. Moreover, because the level at the reset output terminal 47$\overline{Q}$ of the flip-flop 47 remains low, the counting circuit 42 will not be reset by the output of the AND circuit 27.

When the operator is alarmed by the alarm 21 that the valve of the fuel supplying nozzle 10 is open as described before, the operator again unhooks the fuel supplying nozzle 10 from the nozzle accommodating part 11. The switch 12 is accordingly closed, and the output of the monostable multivibrator 35 assumes a high level for an instant. The output of the monostable multivibrator 35 is applied to the reset terminal 41R of the counting circuit 41, to reset the counting circuit 41. On the other hand, the output of the monostable multivibrator 36 also assumes a high level for an instant, and the gate of the AND circuit 27 opens. However, because the level at the reset output terminal 47$\overline{Q}$ of the flip-flop 47 is low in this state, the output of the AND circuit 27 is low and the counting circuit 42 will not be reset.

Then, the operator closes the valve of the fuel supplying nozzle 10 which was unhooked again as described above. After confirming that the valve of the fuel supplying nozzle 10 is closed, the operator again hooks the fuel supplying nozzle 10 back in the nozzle accommodating part 11. As a result, the output of the inverter 31 similarly becomes high as described previously, and the output of the AND circuit 25 becomes high. Hence, the output of the monostable multivibrator 38 assumes a high level only during the predetermined short time t, to rotate the motor 5 for only the short time and to drive the pump 6 for only this short time. Because the valve of the fuel supplying nozzle 10 is closed in this state, only a quantity of fuel of an order which can be absorbed by the expansion of the fuel supplying hose 9 will flow even when the pump 6 is driven.

In addition, when the output of the inverter 31 becomes high, this high-level output of the inverter 31 is applied to the AND circuit 24, and the flow rate signal from the flow rate signal generator 8 is supplied to the counting circuit 41 through the AND circuit 24 to be counted in the counting circuit 41. On the other hand, the comparing circuit 45 compares the predetermined flow quantity which is stored in the memory circuit 43 and the quantity of supplied fuel which is counted in the counting circuit 41, but the flow rate flowing through the flowmeter 7 is less than the predetermined flow quantity because the valve of the fuel supplying nozzle 10 is closed in this state. Thus, no coincidence signal is produced from the comparing circuit 45. Accordingly, the output of the inverter 33 assumes a high level as shown in FIG. 3(L), and the gate of the AND circuit 28 is open.

When the predetermined short time t which is set in the monostable multivibrator 28 elapses, the output of the monostable multivibrator 38 returns to low level, to stop the rotation of the motor 5. Further, the output of the inverter 32 becomes high as shown in FIG. 3(K), and the output of the monostable multivibrator 37 assumes a high level for an instant as shown in FIG. 3(P). As a result, the output of the AND circuit 28 becomes high as shown in FIG. 3(G), and this high-level output of the AND circuit 28 is applied to the reset terminal 47R of the flip-flop 47. The flip-flop 47 is thus reset, and the level at the reset output terminal 47$\overline{Q}$ becomes high. Consequently, the gates of the AND circuits 27 and 29 open, and prepare for a subsequent fuel supplying operation. In addition, the output of the AND circuit 28 is applied to the reset terminal 42R of the counting circuit 42 through the OR circuit 39, to reset the counting circuit 42. Hence, the comparing circuit 46 produces no fixed quantity signal through its output terminal 46A, because the counting circuit 42 is reset. Accordingly, the gates of the AND circuits 24 and 25 close, and the output of the inverter 34 becomes high. The gate of the AND circuit 30 thus opens, and prepares for the subsequent fuel supplying operation. When these operations are performed, all of the circuit elements shown in FIG. 2 return to their original states before the fuel supplying operation was started.

When the fuel supplying nozzle 10 having the closed valve is hooked back in the nozzle accommodating part 11 after the preset fuel supplying operation is completed, the safety check described before will be made automatically. However, since no coincidence signal will be produced from the comparing circuit 45 in this case, the operator will of course not be alarmed.

In the embodiment described heretofore, the control circuit 20 has the construction shown in FIG. 2. The pump driving circuit includes the inverter 31, the AND circuit 25, and the monostable multivibrator 38. Further, the safety check circuit includes the counting circuit 41, the memory circuit 43, the comparing circuit 45, and the flip-flop 47. However, the control circuit, the pump driving circuit, and the safety check circuit are not limited to those described heretofore. For example, the control circuit 20 may be constituted by a microcomputer which comprises a central processing unit (CPU), a memory circuit, and the like. In this case, the microcomputer may be coupled to the flow rate signal generator 8, the switch 12, the preset device 17, the alarm 21, the motor driving circuit 22, and the indicator driving circuit 23, through an interphase circuit, and the fuel supplying operation may be realized by the control of the computer program.

In addition, the control circuit 20 is provided within the upper housing 2*b* in the embodiment described heretofore, however, the control circuit 20 may be located in an office of the fuel supplying station, for example. The preset device 17 was also described as being provided within the upper housing 2*b*, but the preset device 17 may be provided at other locations such as in the fuel supplying nozzle 10, a vicinity of the fuel supplying nozzle 10, and an intermediate part of the fuel supplying hose 9. Further, the preset device 17 may be located in the office or an island of the fuel supplying station, as an independent preset device panel. The housing 1 which constitutes the fuel supplying apparatus was described heretofore as being made up from the upper and lower housings 2*b* and 2*a*, however, it was only a design choice, and the housing 1 may very well be made up from a single housing.

As described heretofore, the fuel supplying apparatus according to the present invention is designed to automatically make a safety check during the preset fuel supplying operation and to determine whether the valve of the fuel supplying nozzle 10 is open, so as to prohibit the motor 5 from being rotated during a subsequent fuel supplying operation if the valve of the fuel supplying nozzle 10 is open. Thus, it is possible to positively prevent the pump 6 from being accidentally started during the subsequent fuel supplying operation, in a state where the valve of the fuel supplying nozzle 10 is open. In addition, the time in which the pump 6 is driven to make the safety check, can be set to a minimum time. Hence, even if the valve of the fuel supplying nozzle 10 is open, the quantity of fuel which is supplied through the fuel supplying nozzle 10 during this safety check, can be set to a minimum quantity. Furthermore by the provision of the alarm 21, the operator will be alarmed in advance if the valve of the fuel supplying nozzle 10 is open, and the subsequent fuel supplying operation can be carried out smoothly.

Figure 4:
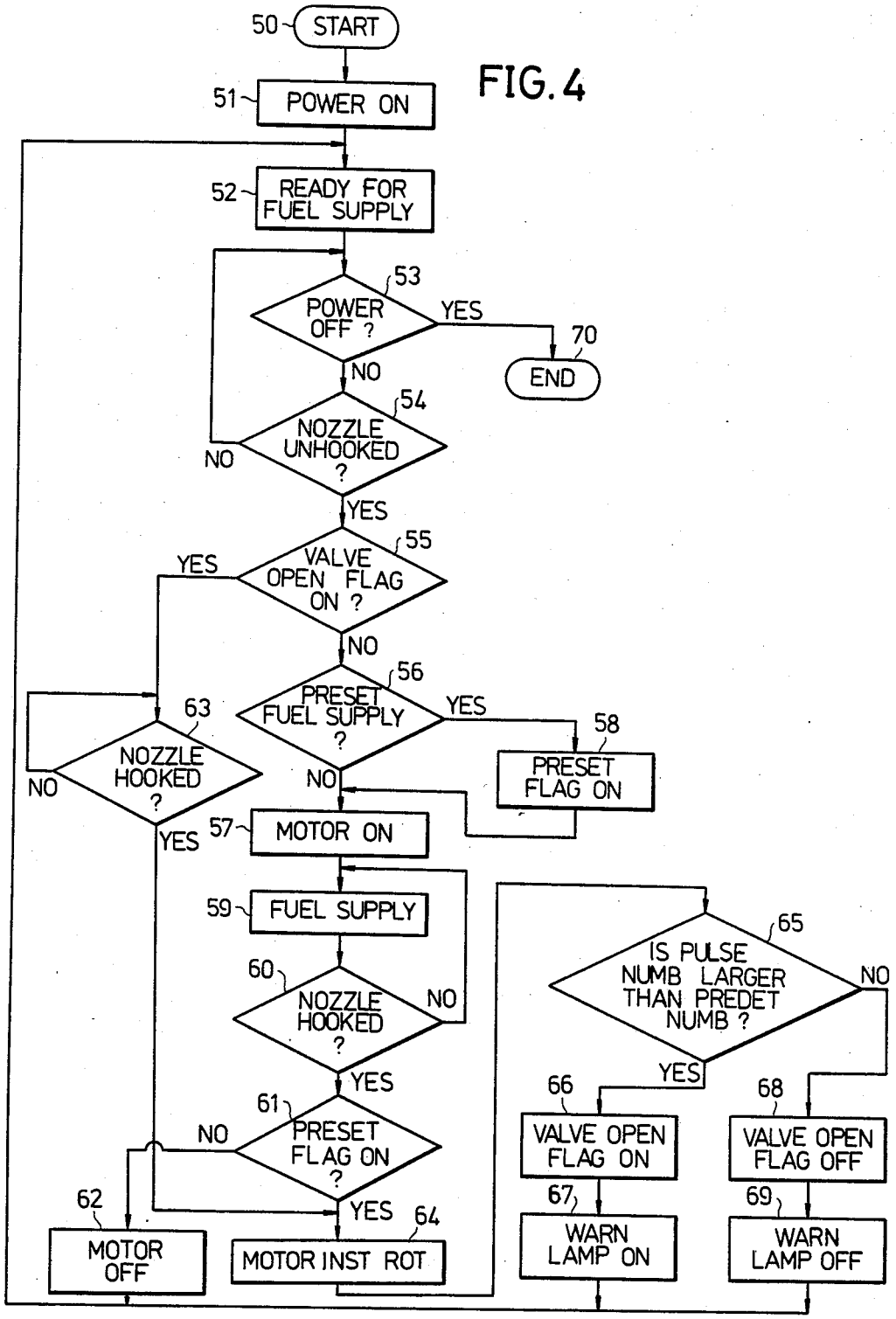
FIG. 4 is a flowchart for explaining the operation of a microcomputer when the control circuit shown in FIG. 2 is constituted by the microcomputer.

The operation of the control circuit 20 shown in FIG. 2 may be carried out by a microcomputer, and the operation of the microcomputer in this case will be described hereinafter by referring to the flowchart shown in FIG. 4.

The operation of the microcomputer is started in a step 50, and the power source of the fuel supplying apparatus is turned ON in a step 51. The fuel supplying apparatus is put into a ready state in which the fuel supplying operation can be started, in a step 52. A step 53 discriminates whether the power source of the fuel supplying apparatus is OFF. If the discrimination result in the step 53 is YES, that is, if the power source is OFF, the operation is ended in a step 70.

If the discrimination result in the step 53 is NO, a subsequent step 54 discriminates whether the fuel supplying nozzle 10 has been unhooked. When the discrimination result in the step 54 is NO, the operation is returned to the step 53, and the discrimination is repeatedly performed in the step 54. When the fuel supplying nozzle 10 is unhooked from the nozzle accommodating part 11 and the discrimination result in the step 54 becomes YES, the operation advances to a step 55 in which discrimination is made to determine whether a valve open flag is ON.

When the discrimination result in the step 55 is NO, a step 56 discriminates whether the operation is a preset fuel supplying operation. If the discrimination result in the step 56 is NO, a step 57 turns the motor 5 ON. On the other hand, if the discrimination result in the step 56 is YES, a step 58 sets a preset flag ON, before advancing to the step 57. A step 59 carries out the fuel supplying operation. A step 60 discriminates whether the fuel supplying nozzle 10 has been hooked in the nozzle accommodating part 11. The operation is returned to the step 59 if the discrimination result in the step 60 is NO. On the other hand, if the discrimination result in the step 60 is YES, a step 61 discriminates whether a preset flag has been set ON.

If the discrimination result in the step 61 is NO, the motor 5 is turned OFF in a step 62, and the operation is returned to the step 52. On the other hand, if the discrimination result in the step 61 is YES, the motor 5 is rotated for an instant (short time) in a step 64. A step 65 discriminates whether a number of pulses generated from the flow rate signal generator 8 is greater than a predetermined number, as the fuel is pumped for a short period due to the rotation of the motor 5. When the discrimination result in the step 65 is YES, a valve open flat is set ON in a step 66, a warning device (alarm device 21) is turned ON in a step 67, and the operation is then returned to the step 52. If the discrimination result in the step 65 is NO, the open valve flat is reset OFF in a step 68, the warning device is turned OFF in a step 69, and the operation is then returned to the step 52. If the discrimination result in the step 55 is YES, a step 63 discriminates whether the fuel supplying nozzle 10 has been hooked back in the nozzle accommodating part 11. When the discrimination result in the step 63 is NO, the discrimination is repeated in the step 63. On the other hand, when the discrimination result in the step 63 is YES, the operation advances to the step 64.

Figure 5:
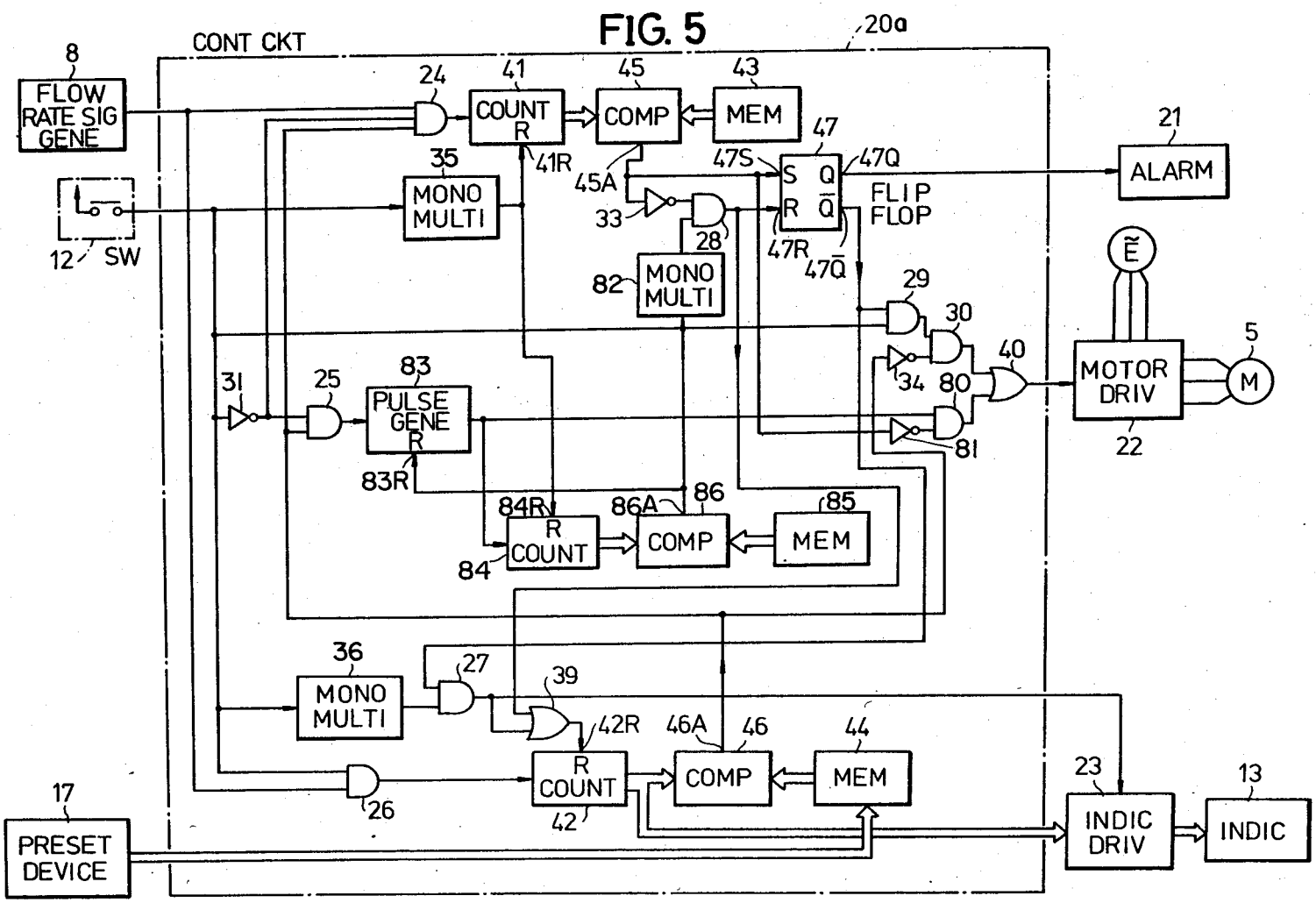
FIG. 5 is a circuit diagram showing a second embodiment of a concrete circuit construction of the control circuit.

Next, description will be given with respect to a second embodiment of a fuel supplying apparatus according to the present invention by referring to FIG. 5. In FIG. 5, those parts which are the same as those corresponding parts in FIG. 2 are designated by the same reference numerals, and their description will be omitted.

A control circuit 20*a* comprises the AND circuits 24, 25, 26, 27, 28, 29, 30, and 31, the inverters 32, 33, 34, and 35, the monostable multivibrators 36, 37, and 38, the OR circuits 39 and 40, the counting circuits 41 and 42, the memory circuits 43 amd 44, the comparing circuits 45 and 46, the flip-flop 47, a pulse generator 48, a counting circuit 49, a memory circuit 50, and a comparing circuit 51. As will be described later on in the specification, the pulse generator 48 generates pulses in terms of a minute time $t_a$ with a predetermined interval $t_b$. The counting circuit 49 counts the pulses generated from the pulse generator 48. A number of times (a numerical value "5", for example) the motor 5 is to be intermittently rotated, is stored in the memory circuit 50. The comparing circuit 51 compares a counted value in the counting circuit 49 and the numerical value stored in the memory circuit 50, and produces an output signal when the two values coincide. The output side of the monostable multivibrator 36 is coupled to the reset terminals 41R and 49R of the counting circuits 41 and 49.

The output side of the pulse generator 48 is coupled to the counting circuit 49, and to the motor driving circuit 22 through the AND circuit 31 and the OR circuit 40. The output terminal 45A of the comparing circuit 45 is coupled to the inverter 33 and the set terminal S of the flip-flop 47. The output terminal 45A is also coupled to the AND circuit 31 through the inverter 35. The input side of the comparing circuit 51 is coupled to the counting circuit 49 and the memory circuit 50. An output terminal 51A of the comparing circuit 51 is coupled to a reset terminal 48R of the pulse generator 48, and to the input side of the AND circuit 28 through the monostable multivibrator 38.

Figure 6:
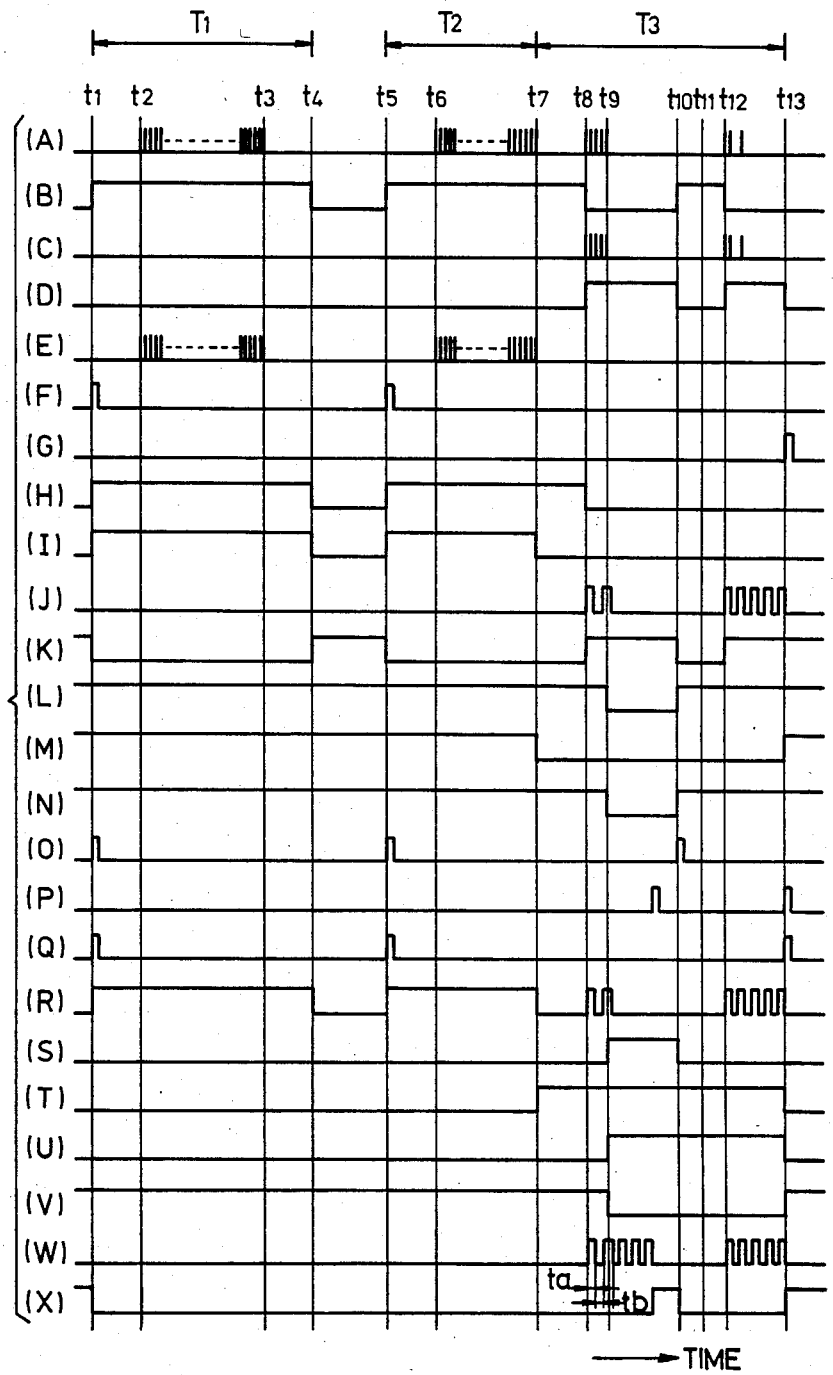
FIG. 6 is a flow chart for explaining the operation of the circuit shown in FIG. 5.

The operation of the control circuit **20*a* will now be described in conjunction with FIG. 6. FIGS. 6(A) through 6(I) show the output signal waveforms of the flow rate signal generator 8, the switch 12, and the AND circuits 24, 25, 26, 27, 28, 29, and 30, and are the same as the signal waveforms shown in FIGS. 4(A) through 4(I). FIG. 6(J) shows the output signal waveform of the AND circuit 31. FIGS. 6(K) through 6(M) show the output signal waveforms of the inverters 32, 33, and 34, and are the same as the signal waveforms shown in FIGS. 4(J), 4(L), and 4(M). FIG. 6(N) shows the output signal waveform of the inverter 81. FIG. 6(O) shows the output signal waveforms of the monostable multivibrators 36 and 37, and is the same as the signal waveforms shown in FIGS. 4(N) and 4(O). FIG. 6(P) shows the output signal waveform of the monostable multivibrator 30. FIG. 6(Q) shows the output signal waveform of the OR circuit 39, and is the same as the signal waveform shown in FIG. 4(R). FIG. 6(R) shows the output signal waveform of the OR circuit 40. FIGS. 6(S) through 6(V) respectively show the output signal waveforms at the output terminals 45A and 46A of the comparing circuits 45 and 46 and the output terminals 47Q and 47$\overline{Q}$ of the flip-flop 47, and are the same as the signal waveforms shown in FIGS. 4(T) through 4(W). FIGS. 6(W) and 6(X) respectively show the output signal waveform of the pulse generator 48 and the output signal waveform at the output terminal 51A of the comparing circuit 51**.

The normal fuel supplying operation and the preset fuel supplying operation are carried out by the control circuit **20*a* similarly as in the first embodiment described before, and description thereof will be omitted. Description will now be given with respect to the safety check operation carried out by the control circuit 20*a***.

When the fuel supplying nozzle 10 is hooked in the nozzle accommodating part 11 and the switch 12 is closed at the time $t_8$, the level at the output of the inverter 32 assumes a high level as shown in FIG. 6(K). The AND circuit 25 receives the output signal of the inverter 31 and the signal from the output terminal 46A of the comparing circuit 46, and the level at the output of the AND circuit 25 assumes a high level as shown in FIG. 6(D). As a result, the pulse generator 48 assumes an operating state, and repeatedly generates pulses. As shown in FIG. 6(W), the pulses generated from the pulse generator 48 assume a high level only for a predetermined minute time $t_a$, and assume a low level for a predetermined minute time $t_b$. The pulses from the pulse generator 48 are supplied to the motor 5 through the AND circuit 31 as shown in FIG. 6(J), the OR circuit 40 as shown in FIG. 6(R), and the motor driving circuit 22. As a result, the motor 5 is repeatedly and intermittently rotated in terms of the predetermined minute time $t_a$, so that the pump 6 is repeatedly and intermittently driven. Accordingly, the fuel is intermittently supplied to the fuel supplying nozzle 10, through the piping arrangement 4, the pump 6, the flowmeter 7, and the fuel supplying hose 9.

On the other hand, the high-level output of the inverter 32 is supplied to the AND circuit 24. Since the fixed quantity signal from the comparing circuit 46 is supplied to the AND circuit 24, the gate of the AND circuit 24 is opened. Hence, the pump 6 is repeatedly intermittently driven in terms of the predetermined minute time $t_a$, and a flow rate which is measured by the flowmeter 7 is supplied from the flow rate signal generator 8 as an intermittent flow rate signal every time the pump 6 is driven. This intermittent flow rate signal is supplied to the counting circuit 41 through the AND circuit 24, and the counting circuit 41 counts the total quantity of supplied fuel in the binary coded decimal notation.

The comparing circuit 45 compares the total quantity of supplied fuel which is counted in the counting circuit 41, and the predetermined flow quantity which is stored in the memory circuit 43. When the valve of the fuel supplying nozzle 10 is open in this state, the fuel which is in excess of the predetermined flow rate will flow out of the fuel supplying nozzle 10. For example, it will be assumed that the pulse is generated from the pulse generator 48 for the second time, and that the comparing circuit 45 produces a coincidence signal shown in FIG. 6(S) through the output terminal 45A at the time $t_9$ when the motor 5 starts to rotate for the second time.

The coincidence signal from the comparing circuit 45 is supplied to the inverter 35, and the level of the output of the inverter 35 changes from a high level to a low level as shown in FIG. 6(N). As a result, the gae of the AND circuit 31 is closed. Thus, although the pulses are continuously generated from the pulse generator 48 as shown in FIG. 6(W), no output is produced from the AND circuit 31. The motor 5 is stopped through the OR circuit 40 and the motor driving circuit 22, and the pump 6 is hence stopped from being driven. Accordingly, even when the valve of the fuel supplying nozzle 10 remains open, no further fuel will flow out of the fuel supplying nozzle 10. As in the case of the first embodiment described before, the warning device 21 operates responsive to the coincidence signal from the comparing circuit 45, and the operator of the fuel supplying station is warned that the valve of the fuel supplying nozzle 10 still remains open.

On the other hand, a numerical value "5", for example, is stored in the memory circuit 50. The numerical number "5" indicates that the motor 5 is to be intermittently rotated five times. The pulses from the pulse generator 48 are successively supplied to the counting circuit 49. The comparing circuit 51 compares the counted value in the counting circuit 49, and the numerical value stored in the memory circuit 50. The comparing circuit 51 produces a coincidence signal through the output terminal 51A when the counted value in the counting circuit 49 becomes equal to "5", as may be seen from FIG. 6(X). This coincidence signal is applied to the reset terminal 48R of the pulse generator 48 so as to stop the generation of the pulses regardless of the output state of the AND circuit 25. In addition, the coincidence signal from the comparing circuit 51 is also applied to the monostable multivibrator 38. The level of the output of the monostable multivibrator 38 assumes a high level for an instant, and the trigger pulse shown in FIG. 6(P) is supplied from the monostable multivibrator 38 to the AND circuit 28. However, the gate of the AND circuit 28 remains closed by the coincidence signal which is supplied from the comparing circuit 45 to the AND circuit 28 through the inverter 33. Hence, the flip-flop 47 will not be reset.

Next, the operator is warned by the warning device 21 that the valve of the fuel supplying nozzle 10 remains open, so the operator again unhooks the fuel supplying nozzle 10 from the nozzle accommodating part 11 at the time $t_{10}$. The switch 12 closes, and the level of the output of the monostable multivibrator 36 assumes a high level for an instant. This highlevel output signal of the monostable multivibrator 36 is applied to the reset terminals 41R and 49R so as to reset the counting circuits 41 and 49. On the other hand, the level of the output of the monostable multivibrator 37 also assumes a high level for an instant, and this high-level output signal of the monostable multivibrator 37 opens the gate of the AND circuit 27. However, in this state, the level at the reset output terminal 47$\overline{Q}$ of the flip-flop 47 is low. For this reason, no output is produced from the AND circuit 27, and the counting circuit 42 will not be reset.

Then, at the time $t_{11}$, the operator closes the valve of the fuel supplying nozzle 10 which he unhooked from the nozzle accommodating part 11. The operator checks that the valve of the fuel supplying nozzle 10 is closed, and thereafter hooks the fuel supplying nozzle 10 back in the nozzle accommodating part 11 at the time $t_{12}$. As a result, the output of the inverter 32 assumes a high level as shown in FIG. 6(K), as in the case described before. The output of the AND circuit 25 hence assumes a high level as shown in FIG. 6(D), and the pulses are generated from the pulse generator 48 as shown in FIG. 6(W). The pulses from the pulse generator 48 are supplied to the motor driving circuit 22 through the AND circuit 31 and the OR circuit 40, so that the motor 5 is rotated in terms of the predetermined minute time $t_a$. In this state, the valve of the fuel supplying nozzle 10 is closed, and only a quantity of fuel which may be absorbed by the expansion of the fuel supplying hose 9 will flow even when the pump 6 is driven.

In addition, when the output of the inverter 31 assumes the high level, this high-level output signal of the inverter 31 is applied to the AND circuit 24. The flow rate which is measured by the flowmeter 7, is produced as the flow rate signal from the flow rate signal generator 8 every time the measurement is made, and is supplied through the AND circuit 24 to the counting circuit 41 to be counted therein. On the other hand, the comparing circuit 45 compares the predetermined flow rate stored in the memory circuit 43 and the total quantity of supplied fuel which is counted in the counting circuit 41. However, since the valve of the fuel supplying nozzle 10 is closed in this state, the flow rate measured by the flowmeter 7 is smaller than the predetermined flow rate, and no coincidence signal is produced from the comparing circuit 45. Accordingly, the output of the inverter 33 assumes a high level, and the gate of the AND circuit 28 is opened.

The pulses from the pulse generator 48 are supplied to the counting circuit 49, and the counted value in the counting circuit 49 coincides with the numerical value "5" stored in the memory circuit 50 when five pulses are supplied to the counting circuit 49. In this case, a high-level coincidence signal is produced through the output terminal 51A of the comparing circuit 51. The high-level coincidence signal from the comparing circuit 51 is applied to the reset terminal 48R of the pulse generator 48 so as to stop the generation of the pulses. Further, the highlevel coincidence signal from the comparing circuit 51 is applied to the AND circuit 28 through the monostable multivibrator 38, and the output of the AND circuit 28 assumes a high level for an instant. As a result, the flip-flop 47 is reset responsive to the output of the AND circuit 28, and the level at the reset output terminal 47$\overline{Q}$ assumes a high level. The gates of the AND circuits 27 and 29 are opened so as to prepare for the next fuel supplying operation. Moreover, the output of the AND circuit 28 is supplied to the reset terminal 42R through the OR circuit 39, to reset the counting circuit 42. Because the counting circuit 42 is reset, the fixed quantity signal is no longer produced through the output terminal 46A of the comparing circuit 46. Therefore, the gates of the AND circuits 24 and 25 are closed. The level at the output of the inverter 34 assumes a high level so as to open the gate of the AND circuit 30 and prepare for the next fuel supplying operation. Consequently, the circuits are returned to the respective original states before the fuel supplying operation was started.

Figure 7A:
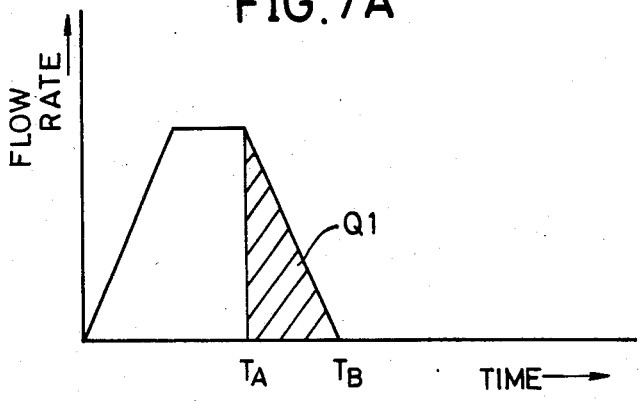
FIGS. 7A and 7B respectively show flow rates during a safety check operation of the first and second embodiments.
Figure 7B:
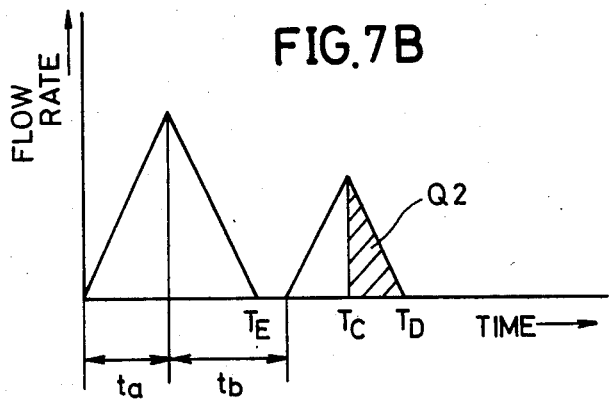

In the first embodiment described before, the pump 6 is continuously driven during the checking operation which is carried out after the preset fuel supplying operation is completed so as to check whether the valve of the fuel supplying nozzle is open or closed. Hence, as shown in FIG. 7A, the open state of the valve of the fuel supplying nozzle 10 is detected by the comparing circuit 45 at a time $T_A$ and the pump is stopped from being driven. However, due to the inertia of the motor 5 and the inertia of the pump 6, the fuel continues to be supplied until a time $T_B$ when the pump completely stops operating, and there is an oversupply quantity $Q_1$ of fuel. On the other hand, according to the present embodiment, the pump 6 is intermittently driven in terms of the predetermined minute time $t_a$ as shown in FIG. 7B. Hence, when the open state of the valve of the fuel supplying nozzle 10 is detected by the comparing circuit 45 at a time $T_C$ and the pump 6 is stopped from being driven, the pump 6 completely stops operating at a time $T_D$ which is only a relatively short time after the time $T_C$. For this reason, the oversupply quantity $Q_2$ of fuel in the fuel supplying apparatus according to the present invention, is small compared to the oversupply quantity $Q_1$ of fuel in the previously proposed fuel supplying apparatus. In a case where the open state of the valve of the fuel supplying nozzle 10 is detected at a point (at a time $T_E$, for example) when the pump 6 driven for an integral number of times completely stops operating, the pump 6 will not be driven further, and the oversupply quantity of fuel is essentially zero.

In a concrete embodiment, the oversupply quantity $Q_1$ of fuel in the first embodiment was 300 cc, while the oversupply quantity $Q_2$ of fuel in the present embodiment was 60 cc.

It was described heretofore that the operation of checking whether the valve of the fuel supplying nozzle 10 is open, is carried out after the preset fuel supplying operation is completed, that is, after the fuel supplying nozzle 10 is hooked back in the nozzle accommodating part 11 and switch 12 is opened. However, this checking operation may be carried out before the fuel supplying operation is started, that is, when the fuel supplying nozzle 10 is unhooked from the nozzle accommodating part 11 and the switch 12 is closed. In this case, the inverter 32 may be omitted so that the pulse generator 48 starts to generate the pulses when the switch 12 closes, and the circuit may be modified so that a delay timer is inserted at the output side of the AND circuit 29. In this case, when the fuel supplying operation subsequent to the preset fuel supplying operation is started, the pump 6 is repeatedly driven and the open state if the valve of the fuel supplying nozzle 10 is checked, so that the pump is driven to carry out the fuel supplying operation after a delay time of the delay timer elapses only when the valve of the fuel supplying nozzle 10 is closed in the normal manner. The number of times the motor 5 is driven intermittently, is not limited to "5".

Figure 8:
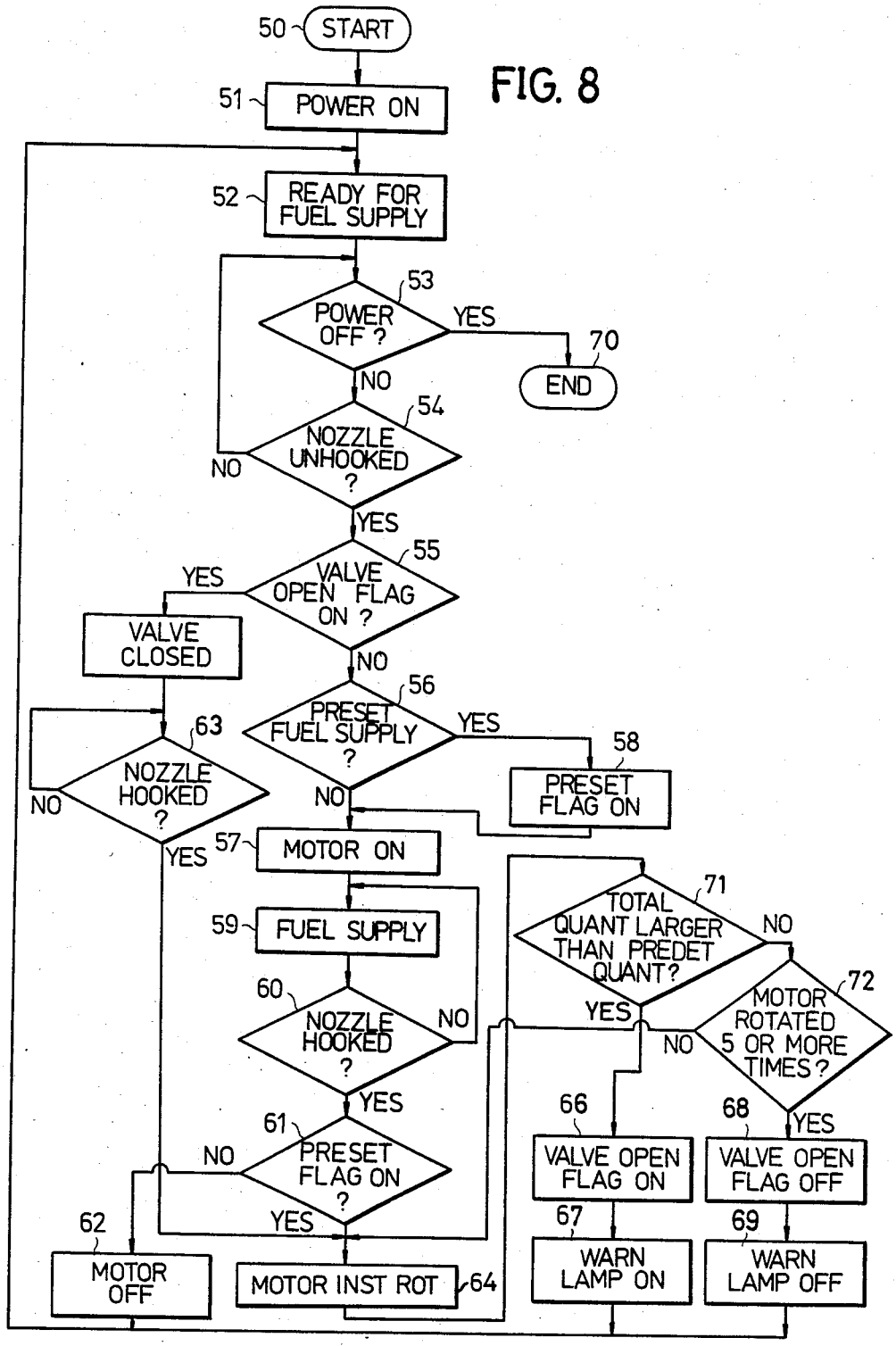
FIG. 8 is a flow chart for explaining the operation of a microcomputer when the control circuit shown in FIG. 5 is constituted by the microcomputer.

The operation of the control circuit 20*a* may be carried out by a microcomputer. The operation of the microcomputer in this case is shown in the flow chart of FIG. 8. In FIG. 8, those steps which are the same as those corresponding steps in the flowchart of FIG. 4 are designated by the same reference numerals, and their description will be omitted. The motor is rotated for the predetermined minute time $t_a$ in the step 64, and a step 71 discriminates whether the total quantity of the supplied fuel is greater than a predetermined quantity. When the discrimination result in the step 71 is NO, a step 72 discriminates whether the motor is rotated for five or more times. When the discrimination result in the step 72 is NO, the operation is returned to the step 64, and the motor is again rotated intermittently to repeat the above described operation. On the other hand, when the discrimination result in the step 71 is YES, the operation advances to the step 66. The operation advances to the step 68 when the discrimination result in the step 72 in YES.

Further, the present invention is not limited to these embodiments, but various variations and modifications may be made without departing from the scope of the present invention.

What is claimed is:

1. A fuel supplying apparatus comprising: a fuel supplying nozzle located at a tip end of a fuel supplying hose;

a pump for supplying fuel to said fuel supplying hose; a flowmeter for measuring a flow rate of the fuel which is supplied by said pump;

a nozzle accommodating part for accommodating said fuel supplying nozzle;

switch means for driving said pump in response to unhooking of said fuel supplying nozzle from said nozzle accomodating part;

preset fuel supplying means for driving said pump and carrying out a fuel supplying operation until a preset fuel supplying quantity or a preset amount of money is reached, said preset fuel supplying quantity and said preset amount of money being preset before the preset fuel supplying operation is started;

short duration pump driving means for driving said pump for a predetermined short time in response to accomodation of said fuel supplying nozzle in said nozzle accommodating part after completion of the preset fuel supplying operation; and safety check means for comparing a measured flow rate which is measured in said flowmeter and a predetermined flow rate when said pump is driven for said predetermined short time, and for prohibiting said pump from being driven in response to the unhooking of said fuel supplying nozzle from said nozzle accommodating part when said measured flow rate is greater than said predetermiend flow rate, even when said switch means operates, said short duration pump driving means intermittently driving said pump in terms of a predetermined minute time ta for a plurality of times.

2. A fuel supplying apparatus as claimed in claim 1 which further comprises a piping arrangement which is provided with said pump at an intermediate part thereof and is coupled to said fuel supplying hose, and collecting means for collecting and returning the fuel which leaks from said fuel supplying nozzle which is accommodated in said nozzle accommodating part to said piping arrangement when said pump is driven for said predetermined short time in a state where a valve of said fuel supplying nozzle is open.

3. A fuel supplying apparatus as claimed in claim 1 in which said predetermined flow rate is selected to a value which is greater than a flow rate which is measured in said flowmeter when said pump is driven for said predetermined short time in a state where a valve of said fuel supplying nozzle which is accommodated in said nozzle accommodating part is closed, and is less than a flow rate which is measured in said flowmeter when the valve of said fuel supplying nozzle which is accommodated in said nozzle accommodating part is open.

4. A fuel supplying apparatus as claimed in claim 1 in which said short duration pump driving means operates only after completion of the preset fuel supplying operation.

5. A fuel supplying apparatus as claimed in claim 1 which further comprises alarm means which operates together with said safety check means, for giving an alarm when said fuel supplying nozzle is accommodated in said nozzle accommodating part in a state where a valve of said fuel supplying nozzle is open after completion of the preset fuel supplying operation.

6. A fuel supplying apparatus as claimed in claim 5 in which said alarm means comprises a warning lamp or a warning buzzer.

7. A fuel supplying apparatus as claimed in claim 1 in which said safety check means prohibits said pump from being driven when said pump is intermittently driven a predetermined number of times by said short duration pump driving means, even when said measured flow rate does not reach said predetermined flow rate.

8. A fuel supplying apparatus as claimed in claim 7 in which said predetermind number of times is set to five.

* * * * *